US006345453B1

(12) United States Patent
Ilomäki et al.

(10) Patent No.: US 6,345,453 B1
(45) Date of Patent: Feb. 12, 2002

(54) METHOD AND APPARATUS FOR DRYING A FIBER WEB

(75) Inventors: Jari Ilomäki; Seppo Mustonen; Timo Ojala, all of Tampere (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/646,212

(22) PCT Filed: Mar. 26, 1999

(86) PCT No.: PCT/FI99/00251

§ 371 Date: Sep. 14, 2000

§ 102(e) Date: Sep. 14, 2000

(87) PCT Pub. No.: WO99/50499

PCT Pub. Date: Oct. 7, 1999

(30) Foreign Application Priority Data

Mar. 31, 1998 (FI) ..... 980726

(51) Int. Cl.[7] ..... F26B 7/00; A47L 5/00

(52) U.S. Cl. ..... 34/508; 34/355; 34/421; 34/429; 34/433; 34/461; 34/71; 34/95; 34/116; 134/64 R; 134/122 R; 15/309.1

(58) Field of Search ..... 34/355, 421, 429, 34/433, 461, 508, 66, 71, 85, 95, 116, 117, 119, 120, 124, 130, 643, 650; 15/302, 309.1; 134/64 R, 104.1, 122 R, 198

(56) References Cited

U.S. PATENT DOCUMENTS 3,891,500 A * 6/1975 Kankaanpaa ..... 162/275
3,910,815 A 10/1975 Shelor
4,356,059 A * 10/1982 Hostetler ..... 162/111
4,461,095 A 7/1984 Lehtinen
4,684,440 A * 8/1987 Penniman et al. ..... 162/184
5,517,714 A 5/1996 Kotitschke
5,594,997 A 1/1997 Lehtinen
5,820,732 A * 10/1998 Gregersen et al. ..... 162/275
5,822,880 A 10/1998 Puumalainen
6,092,298 A * 7/2000 Salminen et al. ..... 34/71
6,094,834 A * 8/2000 Taipale et al. ..... 34/71
6,131,306 A * 10/2000 Retulainen ..... 34/421

FOREIGN PATENT DOCUMENTS

EP 0 763 624 A1 3/1997
WO WO96/11300 A1 4/1996
WO WO97/01668 A1 1/1997

* cited by examiner

*Primary Examiner*—Pamela Wilson
(74) *Attorney, Agent, or Firm*—Alston & Bird LLP

(57) ABSTRACT

The invention relates to a method and apparatus of drying a fiber web (5) which is dried between two tight bands (1, 2) that move in parallel and turn around turning rolls (**6*a*, 6*b*, 7*a*, 7*b*), the first band (1) being heated and the second band (2) being cooled, the fiber web (5) being arranged to run through the drying zone defined by the bands (1, 2) together with at least two felts or wires (3, 4) such that the fiber web (5) is in contact with the surface of the first band (1), a coarse wire (4) is in contact with the surface of the second, cooled band (2), and a fine wire (3) is between the fiber web (5) and the coarse wire (4). The fine wire (3) is cleaned with a cleaning device (11**).

12 Claims, 1 Drawing Sheet

METHOD AND APPARATUS FOR DRYING A FIBER WEB

FIELD OF THE INVENTION

The method relates to a method of drying a fiber web by an apparatus comprising two endless bands that are impermeable to air, first turning rolls around which the first band is arranged to turn, and second turning rolls around which the second band is arranged to turn; the first band and the second band being arranged to run part of the way in parallel such that they define between them a drying zone, the first band being heated and the second band being cooled, and the fiber web and at least two felts or wires, of which at least one is a coarse wire and at least one is a fine wire being arranged to run between the bands in such a manner that the fiber web is in contact with the first, heated band, the coarse wire is in contact with the second, cooled band, and the fine wire, correspondingly, is between the fiber web and the coarse wire.

The invention further relates to an apparatus for dying a fiber web, the apparatus comprising two endless bands that are impermeable to air, first turning rolls around which the first band is arranged to turn, and second turning rolls around which the second band is arranged to turn; the first band and the second band being arranged to run part of the way in parallel such that they define between them a drying zone, the first band being heated and the second band being cooled, and the fiber web and at least two felts or wires, of which at least one is a coarse wire and at least one is a fine wire being arranged to run between the bands in such a manner that the fiber web is in contact with the first, heated band, the coarse wire is in contact with the second, cooled band, and the fine wire, correspondingly, is between the fiber web and the coarse wire.

BACKGROUND OF THE INVENTION

Many patent publications, such as WO 96/11300 and U.S. Pat. No. 4,461,095, teach the drying of a fiber web between two parallel metal bands moving in the same direction such that the fiber web is in contact with the heated metal band and there is a wire between the fiber web and the second, cooled metal band, whereby steam separated from the fiber web by heating condenses to the wire by the effect of the cold metal band. The basic idea is that two endless metal bands are arranged to turn around turning rolls and that against the inner surface of the loops formed by the bands are provided pressure chambers containing hot steam and water, respectively, such that the pressure produced presses the hot and cold bands, respectively, against the fiber web and the wire running between them. Together with seals, the bands located between the pressure chambers define one side of the pressure chambers, whereby the steam and the water can directly affect the bands. The operation of the apparatus is fully known per se and has been disclosed, for example, in the above patent publications, which are incorporated herein by reference.

The basic idea of the operation of the drying apparatus is that because of the heat of the heated band, the water in the web is vaporized and transferred through the wire or wires towards the cooled band. The steam produced on the surface of the cooled band condenses into water and is removed with the cooled band and the wire against it. U.S. Pat. No. 5,594,997 teaches the removal of water from the wire against a cooled band by means of blow and/or suction boxes. In the drying apparatuses described above, the fiber web is guided to and from the apparatus by means of a fine wire. The fine wire is placed between the coarse wire located against the cooled band and the fiber web, and the fine wire further aims to prevent the wiremark on the surface of the web caused by the coarse wire. The small apertures of the wire against the fiber web are susceptible to being clogged, which causes the wire to adhere to the surface of the fiber web. This, again, renders the surface of the web uneven. In addition, clogged apertures prevent the water from passing from the web to the coarse wire, resulting in a lowered drying efficiency of the web.

An object of the present invention is to provide a method and an apparatus which can avoid the above disadvantages.

The method of the invention is characterized by cleaning the fine wire.

SUMMARY OF THE INVENTION

Further, the apparatus of the invention is includes a cleaning device for cleaning the fine wire.

The essential idea of the invention is that a fine wire is arranged between the wire against the cooled band and the fiber web, and the fine wire is cleaned. In a preferred embodiment, the cleaning is performed by spraying water onto the wire by a water nozzle. In another preferred embodiment, after the water nozzles, warm or hot air is blown through the wire from the opposite side to the water nozzles. In a third preferred embodiment, after the water nozzle, warm or hot air is blown through the wire also from the same side of the water nozzle.

The advantage of the invention is that the small apertures of the wire can be kept unclogged and the wire does not adhere to the surface of the wire. Further, as the apertures are unclogged, water from the web passes easily through the wire; in all, the surface of the web can be made even. The water nozzles allow the cleaning to be performed extremely efficiently; the air blowing allows harmful moisture to be discharged from the wire. The moisture would also show in the moisture profile of the web and in the characteristics of finished paper and board. By blowing air also from the opposite side of the wire to the water nozzles allows moisture from the wire to be removed extremely efficiently.

BRIEF DESCRIPTION OF THE DRAWINGS

The invention will be described in closer detail with reference to the attached figure, which is a schematic, sectional side view of a drying apparatus of a fiber web in accordance with the invention, taken in the travel direction of the web.

DETAILED DESCRIPTION OF A PREFERRED EMBODIMENT

Figure 1:
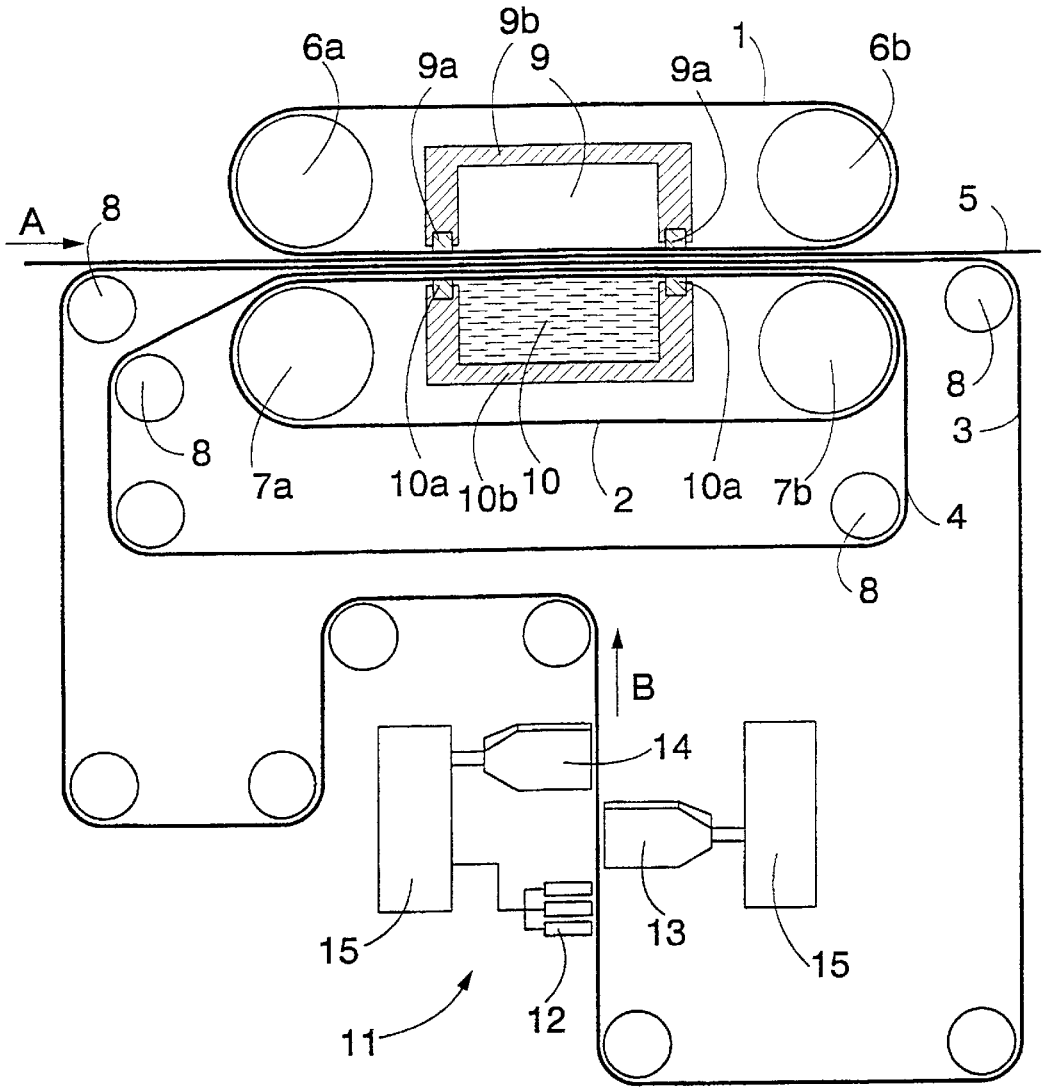

The figure is a schematic sectional side view of an apparatus of the invention in the travel direction of the web. The apparatus comprises a drying device comprising a first band 1, i.e. an upper band, and a second band 2, i.e. a lower band, that are endless, impermeable to air, have good thermal conductivity, and are preferably made of metal. A fine wire or felt 3, a coarse wire 4 and a fiber web 5 pass between those surfaces of the bands that face each other. The fiber web 5 moves in the direction indicated by arrow A. The fiber web is a paper web or a board web, for instance. The first band 1 is arranged to turn around first turning rolls 6*a* and 6*b* located at the ends of the drying apparatus. Correspondingly, the second band 2 is arranged to turn around second turning rolls 7*a*, 7*b* located below the first turning rolls 6*a* and 6*b* likewise at the ends of the drying apparatus. Wires 3 and 4 are supported and guided by means of guide rolls 8. Since the pressure prevailing in the drying zone in the area between the bands 1 and 2 is usually different from the pressure prevailing outside or on the sides of the bands 1 and 2, seals are arranged on both sides of the apparatus between or at the edges of the bands 1 and 2, said seals preventing liquid or vapour from escaping from the space between the bands 1 and 2 through the sides, or vice versa. To effect the vapour heating required by the drying process, the drying apparatus comprises a pressure chamber 9, which is located above the first band 1. The first band 1 is sealed with seals 9*a* in respect of the body 9*b* of the pressure chamber 9 such that the steam in the pressure chamber 9 is maintained at a suitable pressure. Below the second band 2 there is a water chamber 10, which contains a cooling medium, such as water, that cools the second band 2. At the edges of the water chamber 10 there are seals 10*a*, with which the second band 2 is sealed in respect of the body 10*b* of the water chamber 10.

The operation of the drying apparatus is based on heating the first band 1, which comes into contact with the web 5, with hot steam contained in the pressure chamber 9, whereby the water in the web 5 is vaporized and transferred through the wires 3 and 4 toward the second band 2 by the effect of the temperature of the first band 1. The second band 2, in turn, is continuously cooled with the water located below it, whereby the steam produced on the surface thereof condenses into water and is removed with the band 2 and the wire 4.

The fine wire 3 against the fiber web 5 is cleaned by a cleaning device 11. The cleaning device 11 comprises water nozzles 12 for spraying water from the side of the surface against the fiber web 5 of the fine wire 3 onto the fine wire 3 and through it. After the water nozzles 12 in the travel direction of the fine wire 3, there is a first air nozzle 13 arranged on the opposite side of the fine wire 3 in the cleaning device 11. Warm or hot air is blown through the fine wire 3 at a high rate by means of the first air nozzle 13. Further, in the travel direction of the fine wire 3 after the first air nozzle 13, a second air no nozzle 14 is arranged on the same side of the fine wire 3 with the water nozzle 12. By means of the second air nozzle, warm or hot air is also blown through the fine wire 3 at a high rate. The first air nozzle 13 and the second air nozzle 14 can also be placed in an opposite order in the travel direction of the fine wire 3, but most preferably the order is as shown in the figure, whereby the surface of the fine wire 3 against the fiber web 5 more readily remains sufficiently dry.

A plurality of water nozzles 12 and air nozzles 13 and 14 can be provided in the machine and/or cross direction of the fine wire 3. The water nozzles 12 and the air nozzles 13 and 14 can be arranged to traverse, or move back and forth, in the cross direction of the fine wire 3. The nozzles are then, however, arranged with respect to each other such that they process the same point of the fine wire 3. For the sake of clarity, traversing means 15 moving the nozzles back and forth in the cross direction of the fine wire 3 is shown as greatly simplified in the attached figure; for the same reason, the feeding arrangements for feeding air and water to the nozzles are not shown here. The air nozzles 13 and 14 can, however, be so wide that they blow air through the fine wire 3 along the entire width of the wire 3. The fine wire 3 moves also during the cleaning in the direction indicated by arrow B, in other words the fine wire 3 is being cleaned while it is moving.

The air nozzles 13 and 14 are most preferably arranged at an angle of approximately 45° with respect to the weft threads and warp threads of the fine wire 3. The air jets can thus be made to flow more efficiently through the apertures between the weft threads and warp threads in the wire.

The figure and the accompanying description are only intended to illustrate the idea of the invention. The details of the invention may vary within the scope of the claims. It is thus not essential what pressure medium is used in the pressure chamber 9 and the water chamber 10. The pressure medium in the pressure chamber 9 can thus be, for instance, steam, air, hot fuel combustion products or water. The cooling medium in the water chamber 10 can be, for instance, air as well as water.

In addition to the heating by the pressure chamber 9, the first band 1 can also be heated at other places in manners known per se. Further, the first band 1 can also be heated entirely outside the pressure chamber 9, or the fiber web 5 can be dried even without the pressure chamber 9.

Furthermore, the second band 2 can be also cooled outside the water chamber 10 or it can also be cooled even without the water chamber 10 in a manner fully known per se.

What is claimed is:

1. A method of drying a fiber web comprising:

passing the web through an apparatus comprising first and second endless bands that are impermeable to air, first turning rolls around which the first band is arranged to turn, and second turning rolls around which the second band is arranged to turn, portions of the first band and the second band being arranged to run in parallel such that said portions define between them a drying zone, the first band being heated and the second band being cooled, and the fiber web and at least two felts or wires, of which at least one is a coarse wire and at least one is a fine wire, being arranged to run between the bands in such a manner that the fiber web is in contact with the first, heated band, the coarse wire is in contact with the second, cooled band, and the fine wire is between the fiber web and the coarse wire, the fine wire having warp threads and weft threads oriented perpendicularly to each other; and cleaning the fine wire with water jets and, after the fine wire is cleaned with the water jets, drying the fine wire by blowing air with an air nozzle through the fine wire with the air nozzle arranged at an oblique angle with respect to the weft threads and the warp threads of the fine wire.

2. A method as claimed in claim 1, wherein water is sprayed from a first side of the fine wire that is against the fiber web and subsequently, the fine wire is dried by blowing air from both the first side of the fine wire and an opposite second side of the fine wire.

3. A method as claimed in claim 2, wherein after the fine wire is cleaned with the water jet, the fine wire is dried by blowing air from the opposite second side of the wire and subsequently, from the first side of the wire.

4. A method as claimed in claim 1, wherein the fine wire is cleaned with the water nozzle traversing back and forth in a cross direction relative to a travel direction of the fine wire.

5. A method as claimed in claim 1, wherein the first band is heated by a pressure chamber and the second band is cooled by a chamber comprising a pressurized medium.

6. An apparatus for drying a fiber web, the apparatus comprising:

first and second endless bands that are impermeable to air, first turning rolls around which the first band is arranged to turn, and second turning rolls around which the second band is arranged to turn; the first band and the second band having portions arranged to run in parallel such that said portions define between them a drying zone, the first band being heated and the second band being cooled;

at least two felts or wires, of which at least one is a coarse wire and at least one is a fine wire, arranged to run between the bands in such a manner that the fiber web is in contact with the first, heated band, the coarse wire is in contact with the second, cooled band, and the fine wire, is between the fiber web and the coarse wire, the fine wire having warp threads and weft threads oriented perpendicularly relative to each other; and a cleaning device for cleaning the fine wire, the cleaning device comprising at least one water nozzle for spraying water onto the fine wire and at least one air nozzle arranged after the water nozzle in a travel direction of the fine wire for blowing air through the fine wire, the air nozzle being arranged at an oblique angle with respect to the weft threads and the warp threads of the fine wire.

7. An apparatus as claimed in claim 6, wherein the cleaning device comprises at least first and second air nozzles arranged after the water nozzle in the travel direction of the fine wire and wherein the first air nozzle and the second air nozzle are arranged on opposite sides of the fine wire.

8. An apparatus as claimed in claim 7, wherein the water nozzle is arranged on a first side of the fine wire that is against the fiber web, after which the first air nozzle is arranged on an opposite second side of the fine wire, after which the second air nozzle is arranged on the first side of the fine wire.

9. An apparatus as claimed in claim 6, wherein the apparatus comprises traversing means for moving the cleaning device back and forth in a cross direction relative to the travel direction of the fine wire.

10. An apparatus as claimed in claim 6, wherein the apparatus comprises a pressure chamber arranged to heat the first band, and a chamber comprising a pressurized medium arranged to cool the second band.

11. A method as claimed in claim 1, wherein the air nozzle blows air through the fine wire at an angle of approximately 45° relative to the warp threads and the weft threads thereof.

12. An apparatus as claimed in claim 6, wherein the air nozzle is arranged to blow air through the fine wire at an angle of approximately 45° relative to the warp threads and the weft threads thereof.

* * * * *